US009861868B2

(12) United States Patent
Hadad

(10) Patent No.: US 9,861,868 B2
(45) Date of Patent: Jan. 9, 2018

(54) ADAPTABLE PUTTER HEAD

(71) Applicant: Maher Hadad, Quinton, VA (US)

(72) Inventor: Maher Hadad, Quinton, VA (US)

( * ) Notice: Subject to any disclaimer, the term of this patent is extended or adjusted under 35 U.S.C. 154(b) by 0 days.

(21) Appl. No.: 15/130,894

(22) Filed: Apr. 15, 2016

(65) Prior Publication Data

US 2016/0303441 A1 Oct. 20, 2016

Related U.S. Application Data

(60) Provisional application No. 62/147,872, filed on Apr. 15, 2015.

(51) Int. Cl.

| | |
|---|---|
| ***A63B 69/36*** | (2006.01) |
| ***A63B 53/02*** | (2015.01) |
| ***A63B 53/04*** | (2015.01) |
| ***A63B 53/06*** | (2015.01) |
| ***A63B 53/08*** | (2015.01) |

(52) U.S. Cl.

CPC ..... *A63B 53/065* (2013.01); *A63B 53/04* (2013.01); *A63B 53/0487* (2013.01); *A63B 53/08* (2013.01); *A63B 69/3676* (2013.01); *A63B 2053/0491* (2013.01); *A63B 2209/00* (2013.01); *A63B 2209/08* (2013.01); *A63B 2210/50* (2013.01); *A63B 2225/09* (2013.01)

(58) Field of Classification Search

CPC ... A63B 53/065; A63B 69/3676; A63B 53/08; A63B 53/04; A63B 53/0487; A63B 2053/0491; A63B 2209/08; A63B 2210/50; A63B 2225/09; A63B 2209/00

USPC ..... 473/237, 340, 341, 324, 251, 231, 238, 473/313

See application file for complete search history.

(56) References Cited

U.S. PATENT DOCUMENTS

| | | | | |
|---|---|---|---|---|
| 3,397,888 | A * | 8/1968 | Springer | A63B 53/007 473/248 |
| 3,595,582 | A * | 7/1971 | Chapman | A63B 53/0487 473/244 |
| 5,116,047 | A * | 5/1992 | Phelan | A63B 53/007 473/307 |
| 5,924,938 | A * | 7/1999 | Hines | A63B 53/02 473/307 |
| 2010/0167838 | A1* | 7/2010 | Horii | A63B 53/0487 473/341 |
| 2010/0190566 | A1* | 7/2010 | Haack | A63B 53/065 473/252 |
| 2011/0021287 | A1* | 1/2011 | Tucker, Sr. | A63B 53/065 473/334 |
| 2011/0111875 | A1* | 5/2011 | Kuhlman | A63B 69/3614 473/238 |

(Continued)

*Primary Examiner* — Sebastiano Passaniti

(74) *Attorney, Agent, or Firm* — Murray Tech Law; Kenneth A. Murray, Jr.

(57) ABSTRACT

An adaptable putter head that can be easily configured by a golfer for use in training or competitive play is described. The adaptable putter head comprises a center piece and two wings rotatably attached to the center piece. The center piece and wings include a central face and wing faces, respectively. In an extended position, the central face and wing faces form a continuous surface for striking a ball in competitive play. In a retracted position, the central face provides a striking surface with less surface area and the putter head has a lower moment of inertia for skill training and practice.

3 Claims, 5 Drawing Sheets

(56) References Cited

U.S. PATENT DOCUMENTS

2012/0178549 A1* 7/2012 Yoon ..... A63B 53/065
473/334

* cited by examiner

ADAPTABLE PUTTER HEAD

CROSS REFERENCE TO RELATED APPLICATIONS

This application claims the benefit of U.S. Provisional Application No. 62/147,872, filed Apr. 15, 2015.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

FIELD OF THE INVENTION

The invention relates to golf clubs. More particularly, the invention relates to putter heads for training and play.

BACKGROUND

In the game of golf, a "putt" is a stroke used in short-distance shots on or near the putting green, generally with the goal of placing the ball in the hole. For these types of strokes, a specialized golf club called a "putter" is typically used. Putters are differentiated from other types of clubs (such as "irons" and "woods") by a striking surface or "club head" with a very flat, low-profile, low-loft striking face, and by other features which, by game regulation, are only allowed on putters. Such features include bent shafts, non-circular grips, and positional guides.

Putting is often a deciding factor in a game of golf. While the player's skill at putting is an important factor in deciding success, another important contributing factor is the putting device and its performance characteristics. Therefore, many types of putters and putter heads are available to golfers today. Further, many training aids are also available to assist players in improving their putting skills and mechanics.

A golfer's success at putting can be significantly affected by how familiar the golfer is with the particular putter he or she is using. Even slight differences in the weight, grip configuration, putter head shape, size, angle, and striking surface of the club can have a significant impact on the mechanics of the player's putting stroke and the resulting path and velocity of the ball. However, during a competitive game of golf, a player who has been practicing with a putting training aid generally must use a different putter designed for actual play. Changing to a different putter may negatively affect the golfer's play. A performance benefit could be gained by using a putter that could be adapted for both training and for competitive play.

Hence, a need exists for a golf putter that can simultaneously satisfy desired training requirements while being adaptable to a configuration suitable for competitive play. In addition, a significant need exists for such a golf putter where the putter head can be quickly and easily changed from a training configuration to a competitive play configuration. Further, a need exists for such a putter where the operational parameters of the putter are generally consistent when moving from a training mode to a play mode.

SUMMARY

The present invention comprises an adaptable putter head. An embodiment of the invention allows the putter head to be used for both training and play. The putter head is designed so that two wing portions fold back to make the face of the putter head smaller. This allows the putter to be used as a practice device to help train a golfer to strike more putts in the center of the putter head.

The putter is designed to be reconfigurable between a play mode and a training mode. The putter head includes a center piece with two wings that may be either fully extended or folded back. With the wings in a fully extended position, the putter head is placed in a play mode configuration with a full putter face, comprised of the central face and both wing faces, exposed to the golf ball during use. With the wings in a folded position, the putter head is in a training mode configuration with a narrower putter face, comprised of only the central face, exposed to the ball.

When the putter head is reconfigured from one mode to another, the moment of inertia (MOI) of the putter is changed while other features of the putter generally remain constant, e.g., the putter swing weight. In play mode, with wings fully extended, the MOI of the putter is greater than that of the training mode. Hence, in training, with the wings folded back, the MOI is lower and the golfer must exercise more care to control the putter swing and avoid twisting the putter head. The higher the MOI in the putter head, the more resistant it is to twisting on off-center hits, especially helpful for players seeking forgiveness in a putter on mis-hits. Consequently, during play mode, with the wings fully extended, the golfer receives the benefit of a higher MOI to supplement improved skill developed during training with a lower MOI.

The wings are maintained in either a fully extended position or folded position by appropriately placed magnetic components. In addition, a magnetic bolt placed in each wing is adjustable to ensure that the face of each wing is properly aligned with the central face of the putter head when the wings are fully extended. In various embodiments, the wings may be replaced with wings of differing weights to provide a preferred feel to the golfer. Adjustment in weight allows a further change in both the MOI and the swing weight of the putter.

Through the combination of training and a variable MOI, the golfer is able to reduce the probability of a less-than-ideal strike on the golf ball while putting and, hence, improve overall putting results.

BRIEF DESCRIPTION OF THE SEVERAL VIEWS OF THE DRAWINGS

These and other features, aspects and advantages of various embodiments of the present invention will become better understood with regard to the following description, appended claims, and accompanying drawings where:

Figure 1:
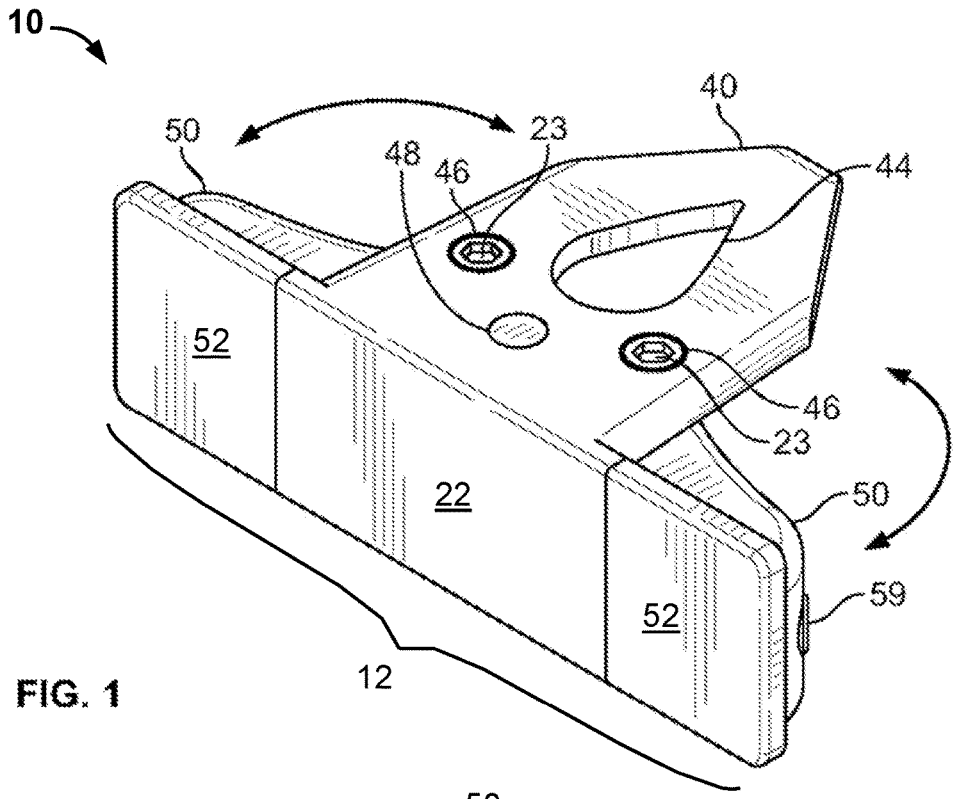
FIG. 1 is a perspective view of an adaptable putter head according to an exemplary embodiment of the invention.

The accompanying drawings numbered herein are given by way of illustration only and are not intended to be limitative to any extent. Commonly used reference numbers identify the same or equivalent parts of the claimed invention throughout the several Figures.

OBJECTS OF THE INVENTION

A first object of an embodiment of the present invention is to provide an adaptable putter head that can be used for both skill training and competitive play.

Another object is to provide an adaptable putter head that can be easily configured by the golfer without any additional tools.

Another object is to provide an adaptable putter head wherein the width of the putter can be adjusted.

Another object is to provide an adaptable putter head that retains a core configuration while various components may be exchanged to change the putter performance parameters.

Other objects of the invention will become apparent through further review of the present disclosure.

DETAILED DESCRIPTION

FIGS. 1 through 8, wherein like parts are designated by like reference numerals throughout, illustrate example embodiments of an adaptable putter head 10 according to the present invention. Although) the present invention will be described with reference to the example embodiments illustrated in the figures, it should be understood that many alternative forms can embody the present invention. One of skill in the art will additionally appreciate different ways to after the parameters of the embodiments disclosed, such as the size, shape, or type of elements or materials, in a manner still in keeping with the spirit and scope of the present invention.

Referring to FIG. 1, a first exemplary embodiment of an adaptable putter head 10 according to the invention is shown. For succinctness, the adaptable putter head 10 will hereinafter be referred to as the putter head 10. The putter head 10 comprises a center piece 20 and two wings 50. The center piece 20 includes a sole 30 and a top 40. The sole 30 rests adjacent the putting surface when the putter is in use. The top 40 is used to attach a putter shaft 60 (not shown) at the hosel 48 of the putter head 10. The center piece 20 further includes a central face 22 for striking a golf ball. Each wing 50 includes a planar wing face 52.

In FIG. 1, the putter head 10 is shown in a play mode, with the wings 50 in a forward, fully extended position. The wings 50 are rotatably attached to the center piece 20 via pin 23. Thus, the wings 50 may be rotated around the axis formed by the pin 23 to move the wings 50 into a retracted folded position, thereby placing the putter head 10 into a training mode.

The center piece 20 and wings 50 can be formed of hard or rigid material, and material having a certain amount of resilience depending on the desired striking characteristics of the putter, including but not limited to plastic, rubber, composites, synthetic materials, natural materials, wood and the like. The putter head 10 may likewise be made from metal or composites, while still providing desired functionality to the golfer. The components of the putter head 10 may be machined or cast. One of skill in the art will appreciate that any number of different materials and manufacturing methods may be utilized, such that the present invention is by no means limited to those specifically listed herein.

Figure 2:
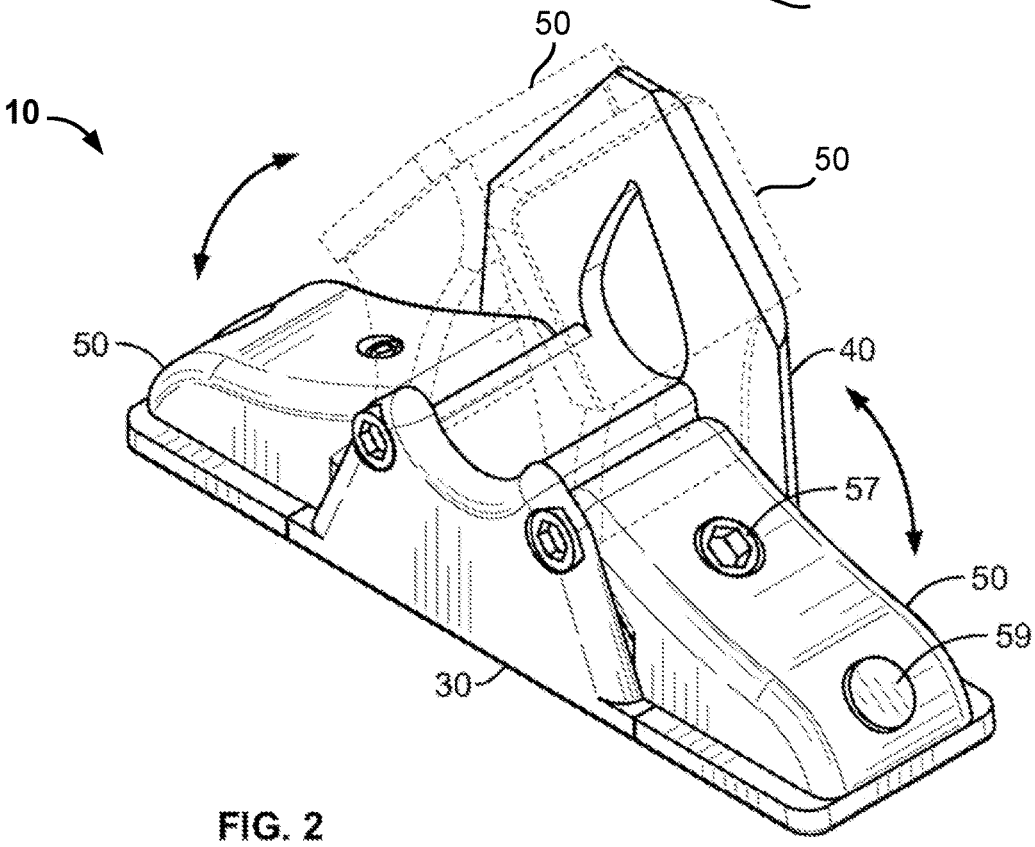
FIG. 2 is a second perspective view of the adaptable putter head of FIG. 1 showing the putter head in both a fully extended and fully folded state.

Now referring to FIG. 2, a perspective view from the sole 30 of the adaptable putter head 10 is shown. The wings 50 are able to rotate from an extended position to a retracted folded position. The retracted folded position of the wings 50 is indicated by the wings 50 shown in dotted lines. As illustrated, the top 40 of the putter head 10 serves to hide the wings 50 when placed in a folded position.

Figure 3:
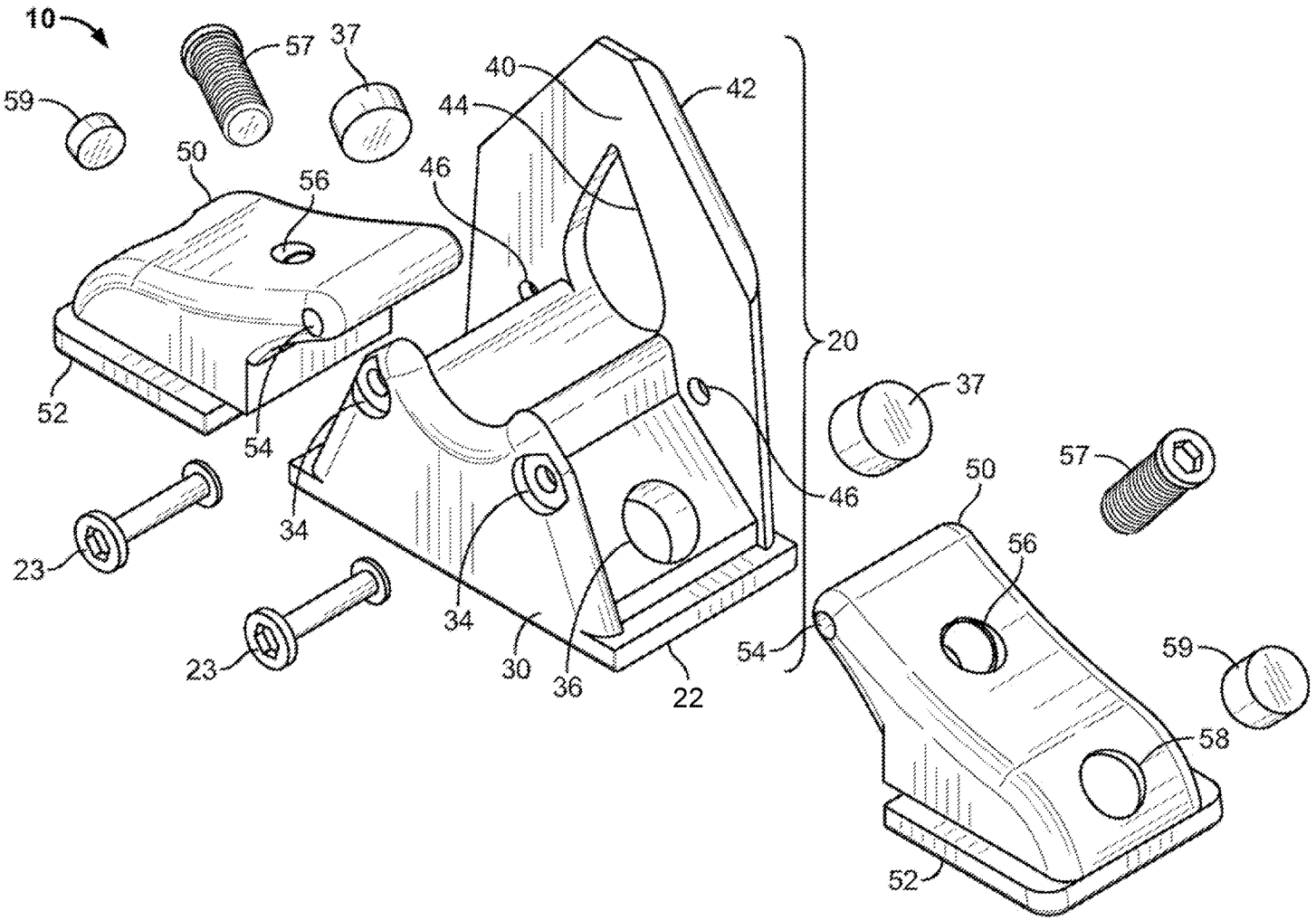
FIG. 3 is an exploded view thereof.

Now referring to FIG. 3, a detailed exploded view of the adaptable putter head 10 is shown. The center piece 20 serves as an anchor piece for the wings 50. The wings 50 are rotationally engaged with the center piece 20 by hinge pin 23. The hinge pin 23 passes through a hole 34 in the sole 30, a sleeve 54 of the wing 50 and a top hole 46 in the top 40. Each wing 50 includes a cylindrical distal receiver 58 into which cylindrical distal wing magnets 59 are affixed. When the putter head 10 is placed in a training mode with the wings 50 in a folded position, the wing magnets 59 come into contact and hold the wings 50 securely in the retracted folded position during use.

Each wing 50 further includes a proximal bolt hole 56 into which magnetic adjusting bolts 57 are threadably engaged. The sole 30 of the center piece 20 includes two cylindrical receptacles 36 into which cylindrical sole magnets 37 are affixed. The sole magnets 37 correspond with each magnetic bolt 57 of each wing 50 such that when the wings 50 are in a forward fully extended position, the wings 50 are secured in place by magnetic attraction between the sole magnets 37 and the magnetic adjusting bolts 57 of each wing 50.

In addition to providing magnetic attraction to maintain the wings 50 in an extended position, the magnetic adjusting bolts 57 are adjustable to ensure that the entire striking surface, i.e., the entire face 12 of the putter, formed by the central face 22 and the wing faces 52, is properly aligned to form a single planar surface from wing 50 to wing 50. When the putter head 10 is in play mode with the wings 50 fully extended, the threadably engaged magnetic adjusting bolts 57 may be adjusted via rotation to eliminate any gaps at the interface between the central face 22 and the wing faces 52 and to ensure that the wing faces 52 are properly aligned with the central face 22. This adjustment feature ensures that the putter head 10 does not strike erroneously when fully extended in a play position. In addition, the adjustment feature allows the putter head 10 to be tuned when first manufactured and throughout its playing life. For example, during repeated use, the sole magnets 37 or hinge pins 23 may wear, requiring adjustment of the magnetic adjusting bolts 57 to ensure the central face 22 and wing faces 52 are aligned.

Figure 4:
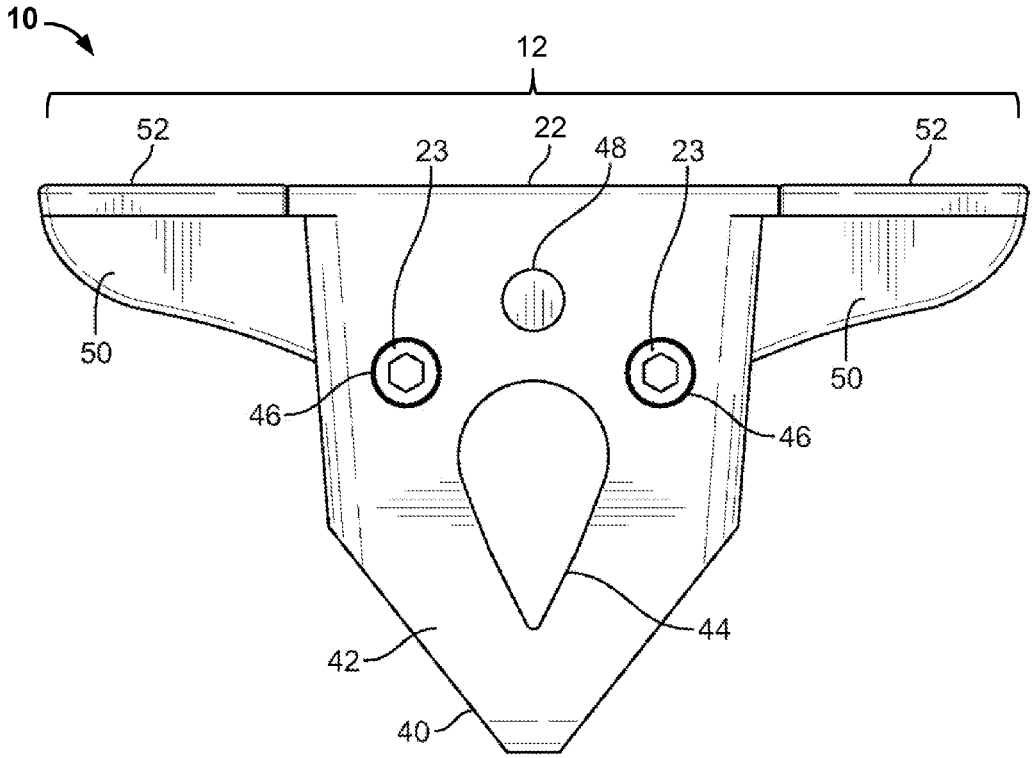
FIG. 4 is a top plan view of the adaptable putter head of FIG. 1 in an extended state.

Now referring to FIG. 4, a top plan view of the adaptable putter head 10 according to the invention is shown. The putter head 10 is shown in a play mode, with the wings 50 in an extended position. In play mode, both wing faces 52 are planar aligned with central face 22 of the putter head 10 forming an entire face 12. Pin 23 is shown inserted through top pin hole 46. The top 40 includes a top surface 42 and a decorative opening 44 in the surface 42 of the top 40. Also shown in the top surface 42 is the hosel 48 through which a putter shaft 60 may be attached to the putter center piece 20. The location of the hosel 48 is shown for exemplary purposes. The hosel 48 may be located elsewhere on the top surface 42 of the putter head 10 to provide variable performance and adapt to different types of putter shafts or player preferences for balance, among other performance parameters.

Figure 5:
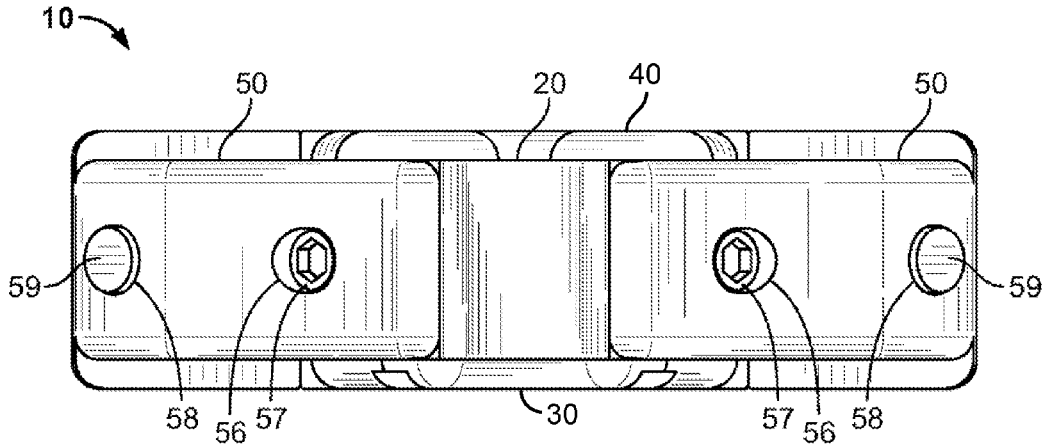
FIG. 5 is a rear elevation view thereof.

Now referring to FIG. 5, a rear elevation view of the adaptable putter head 10 according to the invention is shown. The putter head 10 is shown in a play mode, with the wings 50 in a fully extended position. Magnetic adjusting bolts 57 are deployed within proximal receivers 56. Distal cylindrical magnets 59 are secured within cylindrical distal receivers 58.

Figure 6:
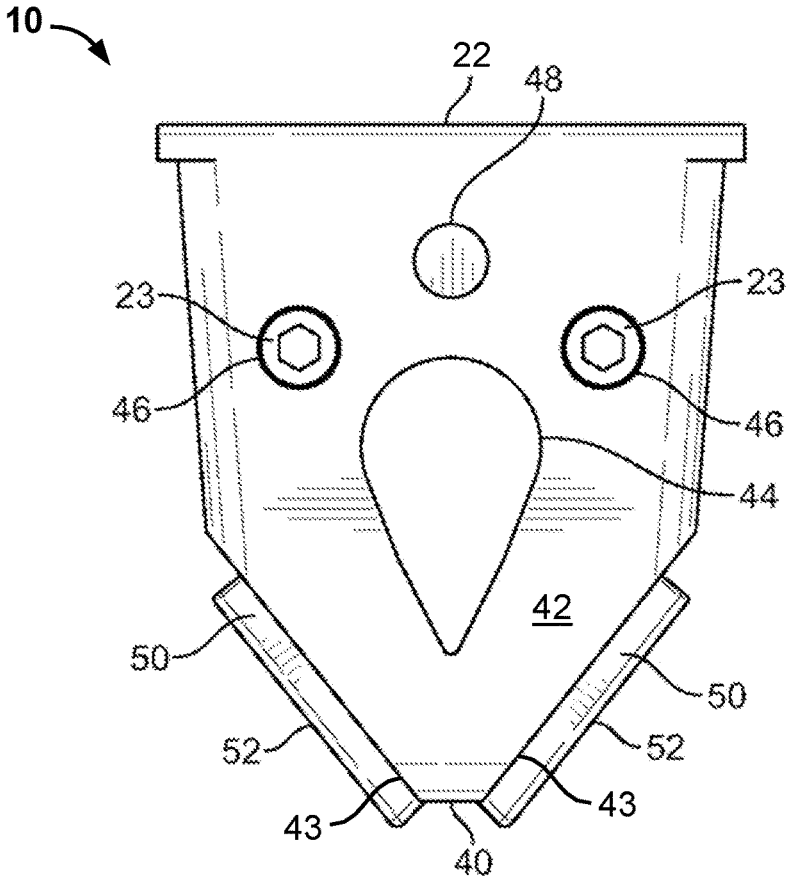
FIG. 6 is top plan view of the adaptable putter head of FIG. 1 in a folded state.

Now referring to FIG. 6, a top plan view of the adaptable putter head 10 in a folded state is shown. The putter head 10 is shown in a training mode, with the wings 50 in a retracted or folded position. The wing faces 52 align with the edges 43 of the top 40 of the putter head 10. The remainder of each wing 50 is hidden by the top 40. Decorative opening 44 is also adaptable to receive a mating insert weight (not shown) which can be used to adjust the weight and MOI of the putter to suit a player's preference or to easily test various swing weights and MOI.

Figure 7:
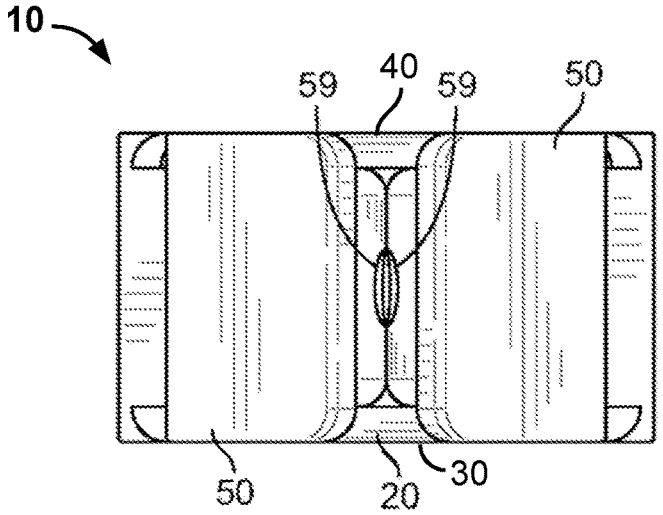
FIG. 7 is a rear elevation view thereof.

Now referring to FIG. 7, a rear elevation view of the adaptable putter head 10 according to the invention is shown. The putter head 10 is shown in a training mode, with the wings 50 in a retracted position. The wing magnets 59 hold the wings 50 securely in the retracted folded position via magnetic attraction.

Figure 8:
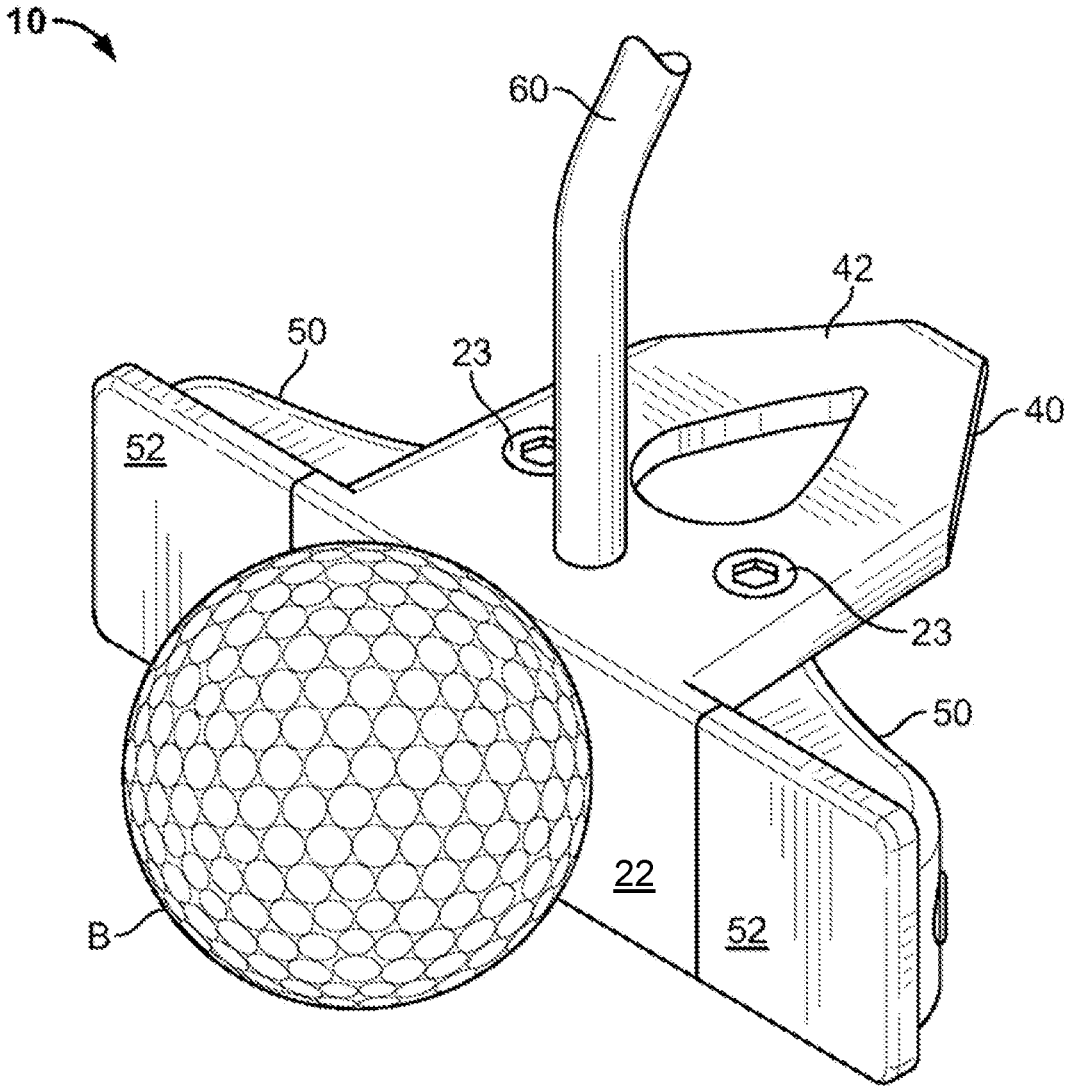
FIG. 8 is a perspective view of the adaptable putter head of FIG. 1 in use with the wings fully extended.

Now referring to FIG. 8, an illustration of the putter head 10 with wings 50 fully extended is shown. The putter head 10 is configured to receive a putter shaft 60 acceptable to the preferences of the golfer. A golf ball B is positioned adjacent the central face 22. Thus deployed, a golfer is now able to use the same putter for practice as for actual play.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The inventions illustratively disclosed herein may be practiced without any element which is not specifically disclosed herein.

I claim:

1. An adaptable putter head comprising:

a. a center piece including
   i. a sole adapted to slidably engage a putting surface, the sole having two holes, and two cylindrical receptacles;
   ii. a top having a top surface, a hosel, and two top holes; and
   iii. a central face for striking a golf ball;

b. two wings, each of said wings having a planar wing face, a sleeve, a cylindrical distal receiver, and a proximal bolt hole;

c. two cylindrical distal wing magnets, one cylindrical distal wing magnet affixed inside each of the cylindrical distal receivers of each of the wings;

d. two magnetic adjusting bolts threadably engaged into each of the proximal bolt hole of each of the wings;

e. two cylindrical sole magnets affixed inside the two cylindrical receptacles, respectively;

f. wherein the wings are rotationally engaged with the center piece by two hinge pins;

g. wherein each of the hinge pins passes through each of the holes, the sleeve of each of the wings, and the top holes;

h. wherein the sole rests adjacent to a putting surface when the adaptable putter head is in use;

i. wherein the top is used to attach a putter shaft at the hosel;

j. wherein the adaptable putter head may be placed in a play mode, with the wings in a forward, fully extended position;

k. wherein the adaptable putter head may be placed in a training mode, with the wings rotated around the axis formed by each respective said hinge pin to move the wings into a retracted folded position;

l. wherein when the adaptable putter head is placed in the training mode with the wings in the retracted folded position, the cylindrical distal wing magnets come into contact with each other and hold the wings securely in the retracted folded position during use;

m. wherein when the adaptable putter head is placed in the play mode, a striking surface is formed by the central face and the planar wing faces;

n. wherein when the adaptable putter head is placed in the play mode, the magnetic adjusting bolts are adjustable to ensure that the striking surface formed by the central face and the planar wing faces is properly aligned to form a single planar surface; and o. wherein the sole magnets correspond with the magnetic adjusting bolts of the wings such that when the wings are in a forward, fully extended position, the wings are further secured in place by magnetic attraction between the sole magnets and the magnetic adjusting bolts.

2. The adaptable putter head of claim 1, wherein the hosel may be located elsewhere on the top surface to provide variable performance and adapt to player preferences for balance and performance parameters.

3. The adaptable putter head of claim 1, wherein the top further includes a decorative opening adaptable to receive a mating insert weight which may be used to adjust a weight and moment of inertia of the adaptable putter head to suit a player's preference and to easily test various swing weights and moment of inertia.

* * * * *